US009689575B2

(12) United States Patent
Donofrio

(10) Patent No.: US 9,689,575 B2
(45) Date of Patent: Jun. 27, 2017

(54) INDOOR GRILL

(71) Applicant: John Donofrio, Bridgeville, PA (US)

(72) Inventor: John Donofrio, Bridgeville, PA (US)

(73) Assignee: GRILL-TOP, INC., Bridgeville, PA (US)

( * ) Notice: Subject to any disclaimer, the term of this patent is extended or adjusted under 35 U.S.C. 154(b) by 319 days.

(21) Appl. No.: 14/697,316

(22) Filed: Apr. 27, 2015

(65) Prior Publication Data

US 2015/0316272 A1 Nov. 5, 2015

Related U.S. Application Data

(60) Provisional application No. 61/986,474, filed on Apr. 30, 2014.

(51) Int. Cl.
*F24C 15/20* (2006.01)

(52) U.S. Cl.
CPC ..... *F24C 15/2071* (2013.01); *F24C 15/2035* (2013.01); *F24C 15/2042* (2013.01)

(58) Field of Classification Search
CPC ..... F24C 15/2035; F24C 15/2071; F24C 15/2042; A47J 37/0704
See application file for complete search history.

(56) References Cited

U.S. PATENT DOCUMENTS

| | | | |
|---|---|---|---|
| 4,244,979 | A | 1/1981 | Roderick |
| 4,510,854 | A | 4/1985 | Robertson |
| 4,561,348 | A | 12/1985 | Halters et al. |
| 4,800,865 | A | 1/1989 | Setzer |
| 5,197,379 | A | 3/1993 | Leonard, Jr. |
| 5,862,741 | A | 1/1999 | Wodeslavsky |
| 6,363,842 | B1 | 4/2002 | Lin |
| 7,044,050 | B1 | 5/2006 | Cook |
| 7,301,128 | B2 | 11/2007 | Li et al. |
| 8,381,638 | B1 | 2/2013 | Rhee |

*Primary Examiner* — Alfred Basichas
(74) *Attorney, Agent, or Firm* — William F. Lang, IV; Lang Patent Law LLC

(57) ABSTRACT

An indoor grill includes a system for retaining a desired amount of heat and smoke during cooking, while passing excess smoke through a filtering system. A water tray is disposed below the heating element, thereby resisting a tendency for dripping grease to create excessive smoke. A hood includes interior and exterior portions, with a space defined therebetween, and the space being accessible along the bottom edge of the hood. A filtration system is connected to the space between the interior and exterior housing portions. Smoke is drawn into the space between the inner and outer hood from the bottom edge, permitting some smoke to remain within the hood for flavoring. When the hood is opened, the hood's edge is raised, raising the entrance to the space between the inner and outer portions up towards the smoke that remained within the hood, and drawing that smoke into the filtration system.

3 Claims, 10 Drawing Sheets

INDOOR GRILL

CROSS REFERENCE TO RELATED APPLICATION

This application claims the benefit of U.S. provisional patent application Ser. No. 61/986,474, filed Apr. 30, 2014, and entitled "Electric Grill."

TECHNICAL FIELD

The present invention is related to indoor grills. More specifically, an electric grill with a system for controlling cooking temperature and limiting the exit of smoke during and after cooking is provided.

BACKGROUND INFORMATION

Grilling is a preferred means of preparing many different foods. Grilling allows that to drip away from the food before it is consumed, resulting in healthier, lower fat food. Grilling also improves the flavor of many foods. The "grill marks" produced where the food contacts the rack of the grill is the result of "caramelization," or the browning of the sugars within the food, which improves the flavoring of the food. Additionally, the food may absorb various flavors from the smoke produced within the grilling process.

Grilling is typically performed outdoors, where charcoal or propane are burned to produce the necessary heat. Depending on the temperature and/or any precipitation, outdoor cooking may not always be desirable. Presently available indoor grills often do not reach the temperature necessary to produce caramelization, and therefore do not produce the same flavoring effects as outdoor grills. Many presently available indoor grills are also designed not to produce smoke, so that the flavoring effects of the smoke are unavailable. If smoke is produced, discharging the smoke into the interior of the house is undesirable. It is also desirable to control the heat on the exterior surfaces of indoor grills, due to their proximity to flammable materials as well as the possibility that children or others may accidently come into contact with an exterior grill surface.

An example of an indoor grill is U.S. Pat. No. 4,561,348. The grill disclosed therein includes an enclosure having an upper plate disposed below the outer housing top, creating an air space therebetween. The upper plate includes a suction opening having an electric fan to direct airflow into the space between the plate and the outer housing, where the air is heated by heating elements disposed therein. Apertures disposed near the heating elements allow the heated air to flow back into the cooking area. The motor for the fan blades also powers a second set of fan blades for directing airflow from outside of the apparatus to a space between the insulating upper wall and an outer casing. The outer casing is thereby kept cool to the touch. The airflow is intended to be hot enough to cook meat, but not hot enough to scorch meat. A second set of heat radiators is provided to scorch the surface of the meat. The fat tray is screened from hot airflow to prevent evaporation of the fat. Although this device provides the heat of a grill, it does not provide the smoke flavoring that a grill would provide.

U.S. Pat. No. 8,381,638 discloses a grill configuration having a forced air curtain. The forced air curtain is intended to limit smoke emissions from the grill. The grill includes a housing with an open top. Grilling bars are disposed a few inches below the open top. Heat sources such as charcoal receptacles with gas jets are disposed below them are positioned below the grilling bars, with a water tray positioned directly under the grilling bars. A pair of air manifolds are disposed on either side of the open top. One air manifold includes a supply fan, and the other air manifold includes an exhaust fan. Air is directed by the supply fan through the first manifolds, across the top of the grill, and into the second manifold through the exhaust fan, thereby trapping smoke below the airflow in order to flavor the food. The water tray is structured to resist burning and smoking of drippings. Air exiting the second air manifold is directed through a bubble filter having a reservoir filled with water. Although smoke is trapped during cooking, it would obviously not be trapped once the grill is opened to access the food after cooking.

U.S. Pat. No. 4,244,979 discloses an oven type apparatus. The apparatus includes an air passage disposed between the inner and outer walls of the main portion of the device. Louvered slots provide for limited airflow between the main compartment and the air passage. A blower is provided for blowing air in a circular path through the air passage, around the main compartment. A heater, followed by a water pan, are disposed after the blower. Air circulating through the air passage creates a pressure differential between the air passage and the main compartment, causing moisture to be drawn from the main compartment into the air passage, resisting any tendency for food to become soggy. At the same time, the circulating air provides for uniform heat distribution throughout the main compartment. The device is particularly useful for slow cooking of foods, grilling effects would not be accomplished by this device.

U.S. Pat. No. 5,197,379 discloses an outdoor cooker. The outdoor cooker includes a housing having double walled construction, having an insulating dead air space between the inner and outer walls. A fuel tray is disposed at the bottom of the housing. A deflector is located above the fuel tray, below the cooking grid. The V-shaped drip tray is disposed between the cooking grid and the deflector. Drippings are collected and prevented from contacting the burning fuel and being incinerated. The housing also includes a removable hood with an inspection opening. Food is thereby exposed to the heat indirectly rather than directly, thereby reducing the cooking temperature. Spit supports are provided so that a spit may be used to cook a large food item such as a turkey. Thus, by exposing the food to the heat indirectly, the device achieves a different purpose than that which would be achieved by grilling.

U.S. Pat. No. 4,510,854 discloses a compact barbecue oven. The barbecue oven includes a cabinet housing a rotisserie in the upper portion of the cabinet, a firebox in the lower portion of the cabinet, a burner for burning wood within the firebox, a flue, and an exhaust unit on top of the cabinet. The cabinet walls are made of spaced apart sheets of metal. An angled baffle wall is located between the rotisserie and the firebox, shielding food on the rotisserie from the firebox. The baffle wall permits air and smoke to flow between the baffle wall and the housing, so that the heat may cook the food and the smoke may impart flavor. The rotisserie is structured to turn a group of trays in a circular path. The firebox includes a vent to permit air to enter the firebox to support combustion. The flue is structured to receive smoke and air after it has passed from the firebox to the rotisserie area, and then back down towards a rear portion of the firebox, where a fan directs air and smoke into the flue. The exhaust unit may also be used to draw smoke and air out of the oven chamber. A drip pan is located at the bottom of the chamber, below the firebox. The pan includes a drain hose. Although this device is designed to use the smoke to impart flavor, it is not designed to cause grill marks or caramelization of the food.

U.S. Pat. No. 7,044,050 discloses an indoor barbecue system. The barbecue system includes a mechanism for withdrawing heat and smoke from the interior so that the enclosure can remain smoke-free during cooking. Some examples are structured to connect to an already existing dryer vent system. A mechanism for disseminating an artificially flavored air stream is disposed between the heat supplying mechanism and the food. The exhaust conduit includes a fan assembly for extracting smoke and heat through the exhaust conduit. A drip pan is disposed immediately below the cooking surface, so the drippings do not reach the heat supplying mechanism. Although this system will clearly dissipate smoke during cooking, it might be desirable instead to retain a certain amount of smoke for flavoring purposes, and then to dissipate this smoke at the conclusion of cooking.

U.S. Pat. No. 7,301,128 discloses a portable electric grill. The grill includes a central frame member having first and second hingedly attached frame members on either side. One of the hingedly attached frame members supports a griddle surface, and the other supports a grill surface. The grill plate and griddle plate have raised peripheral edges to retain grease drippings. The drippings are carried by drain tubes to a drip tray. The drip tray is located within the central frame member. The first and second frame members can be folded from a vertical storage and transportation position to a horizontal cooking position. The central frame member includes a removable vent plate wherein an air filter is disposed. An exhaust fan used to draw smoke and cooking fumes through the vent plate and filter, propelling the filtered air through an exhaust vent. With no lid, this device has no way to retain a certain amount of smoke in the cooking area for flavoring.

U.S. Pat. No. 5,862,741 discloses an indoor and outdoor smokeless grill. The exterior housing is a round a sleeve that is structured to be positioned above the stove. A grill is mounted on top of a round dish that sits on top of the sleeve. A water tray is disposed within the sleeve to catch drippings from the grill. The water tray is filled with water. The water in the water tray boils, turning to steam, and preventing the food from burning, by reducing the temperature of the heating air. In one example, the water container is connected to a bimetallic strip. When the bimetallic strip is heated, it pulls the water container upward, reducing the size of the air passage around the water container, and thereby controlling the extent to which the food is heated. This device will result in a different cooking effect than grilling: rather than producing grill marks and caramelization, this device will resist burning during cooking.

U.S. Pat. No. 6,363,842 discloses an indoor grill having a filter. The base includes a cooking surface. A post extends upward from the rear of the base to support a filter unit thereon. The filter system includes a hood for collecting smoke and other combustion byproducts, a ventilation system including a fan, and a replaceable filter. The grill is open, so smoke will either be absorbed by the filter system or dissipated into the surrounding air, leaving no way to retain a desired amount of smoke in the cooking area for flavoring.

U.S. 4,800,865 discloses a portable cooking device. The device includes a housing that is structured to overlie a conventional barbecue grill. The bottom surface of the housing is semi conductive of heat. A partition is disposed on either end of the cooking surface, with an opening defined in the housing on the opposite side of the partition to allow heat and smoke to pass around the edges of the cooking surface, around the partition, and then into the area where food is cooked. Vents are provided to allow heat and smoke to vent from a lower portion of the cooking chamber. This device does little to reduce the problem of smoke during indoor grilling.

Accordingly, there is a need for an improved indoor grill. There is an additional need for an indoor grill that approximates the cooking characteristics of an outdoor grill, including caramelization, grill marks, and smoke flavoring. There is a further need for an indoor grill that resists the passage of smoke out of the grill into the interior of the building. There is yet another need for an indoor grill that retains a desired amount of smoke within its hood, and then removes that smoke through its filtration system upon opening the grill.

SUMMARY

The above needs are met by an indoor grill. The indoor grill includes a base having a base housing having an open top. A heating element is disposed within the base housing. A rack is disposed above the heating element. A hood is hingedly secured to the base. The hood pivots between a closed position wherein the hood substantially covers the rack, and an open position. The hood includes an outer housing. The outer housing has a plurality of side walls, with the side walls each defining a bottom edge that is structured to abut the base when the hood is in its closed position. The hood also includes an inner housing. The inner housing defines a plurality of side walls, with the side walls each defining a bottom edge that is structured to be spaced from the base and the rack when the hood is in its closed position. The inner housing and outer housing define an open space therebetween and a smoke entrance between the bottom edges of the inner and outer walls. The indoor grill further includes a filtration system in communication with the open space between the inner housing and outer housing. The filtration system has a filter, as well as a fan that is structured to create an airflow from the open space between the inner and outer housings through the filter.

During cooking, a quantity of smoke is retained within the hood, and excess smoke is drawn into the space between the inner housing and outer housing, where it travels through the filter before exiting the grill. When the hood is opened, the smoke entrance around the bottom edge of the hood is raised above the grill rack, thereby drawing previously retained smoke into the smoke entrance and then through the filtration system.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 8:
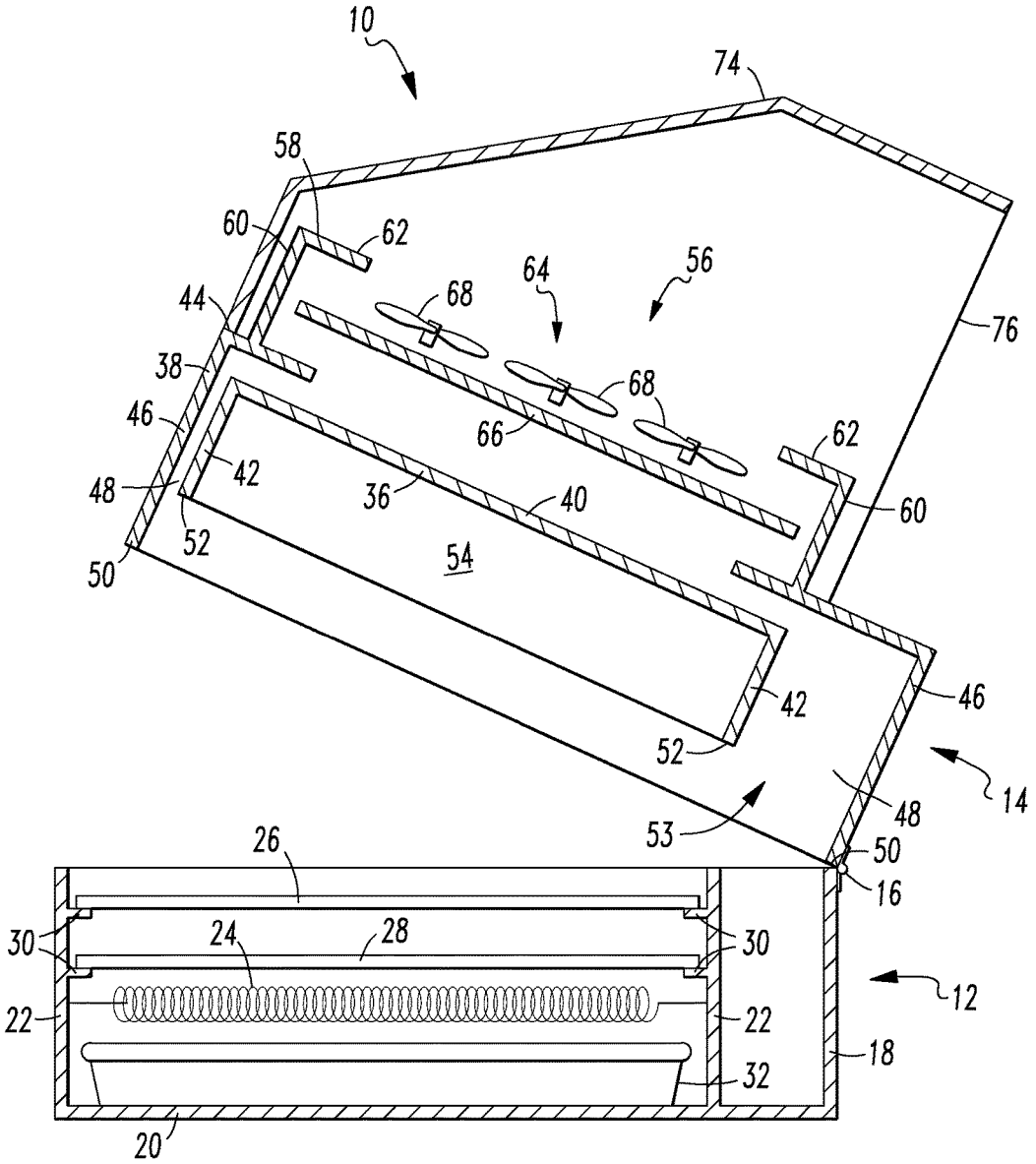
FIG. 8 is a side cross sectional view of the indoor grill of FIG. 1, showing the lid partially opened.

Referring to the drawings, an indoor grill 10 is shown. Referring to FIGS. 1-3 and 8, the grill 10 includes a base 12 and a hood 14 secured to the base 12 by the hinge 16 (FIGS. 4 and 8).

Referring to FIGS. 1-3 and 7-8, the base includes a housing 18 having a bottom 20 and side walls 22. In this context, "side" includes the front side and back side as well as the right and left sides, and may also include a number of sides that is equal to, greater than, or less than four. A heating element 24 is disposed within the housing 18. In the illustrated example, the heating element 24 is an electric heating element. At least one grill rack is disposed above the heating element 24. In the illustrated example, a grill rack 26 is disposed above a grill rack 28, with the grill rack 28 defining smaller openings therein than the grill rack 26. Rack supports 30 protrude inward from the walls 22 to support the racks 26, 28. A water tray 32 is disposed below the heating element 24. A slot 34 is defined within one of the walls 22 to facilitate removal and replacement of the water tray 32.

Continuing to refer to FIGS. 1-4 and 8, the hood 14 includes an inner housing 36 and an outer housing 38. The inner housing 36 includes a top 40 and sides 42. Similarly, the outer housing includes a top 44 and sides 46. As before, "sides" may include the front side and back side as well as right and left sides, and may include a number of sides that is equal to, greater than, or less than four. The inner housing 36 is generally nested within the outer housing 40, and a space 48 is defined between the inner housing 36 and outer housing 38. The sides 46 of the outer housing 38 include edges 50 that are structured to abut the base 12 when the hood 14 is closed. The sides 42 of the inner housing 36 include edges 52 that are structured to be spaced from the base 12 when the hood is closed. The space 48 between the inner housing 36 and outer housing 38 is therefore in communication with the interior 54 of the hood 14.

Figure 1:
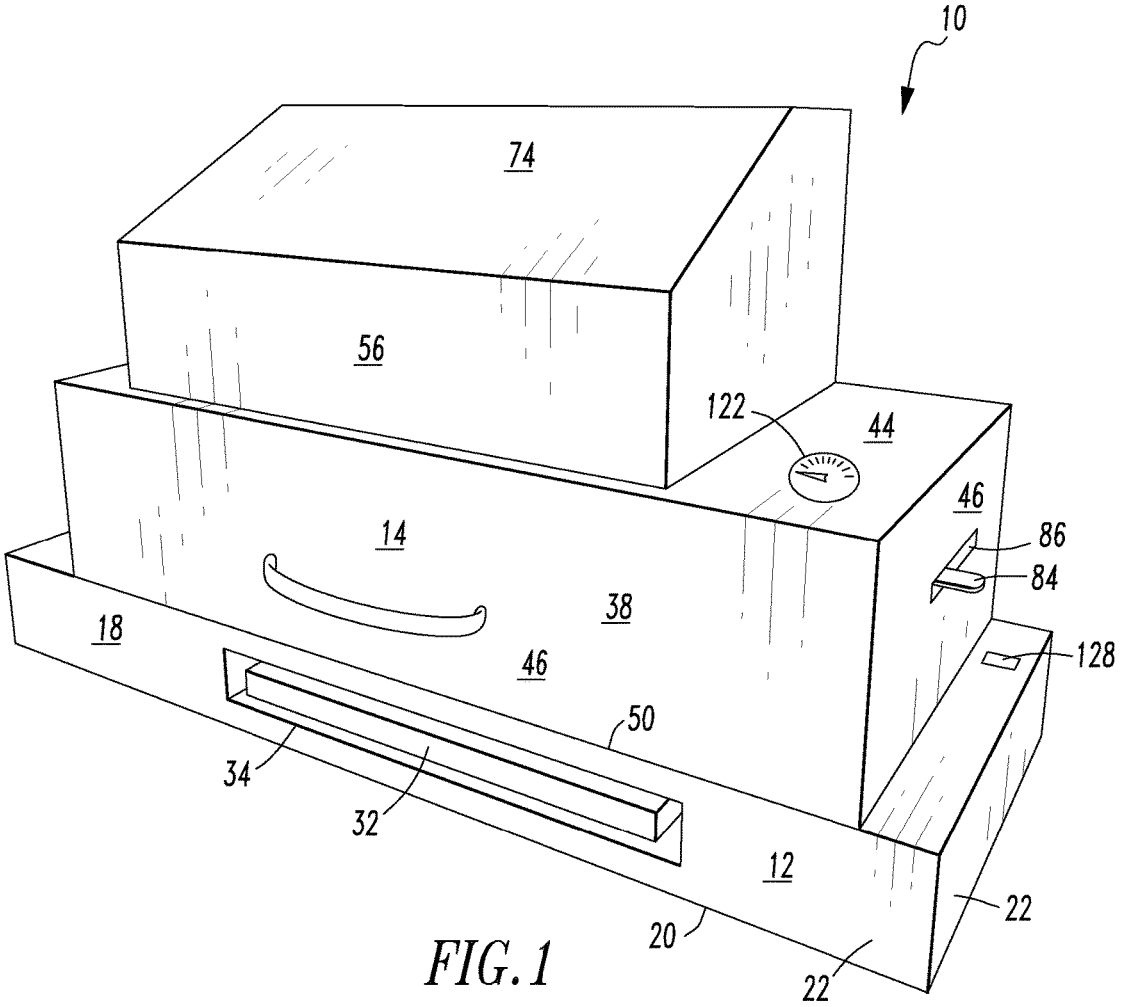
FIG. 1 is a perspective front view of an indoor grill.
Figure 2:
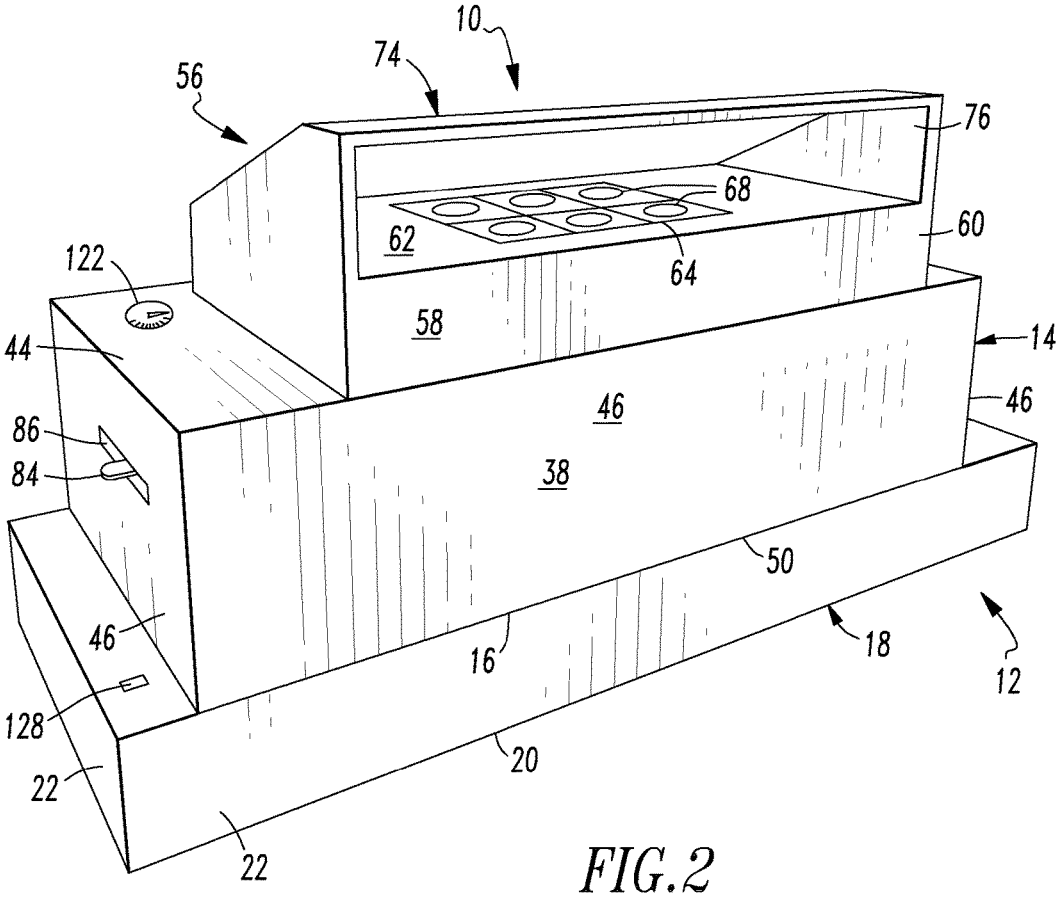
FIG. 2 is a perspective back view of the indoor grill of FIG. 1.
Figure 3:
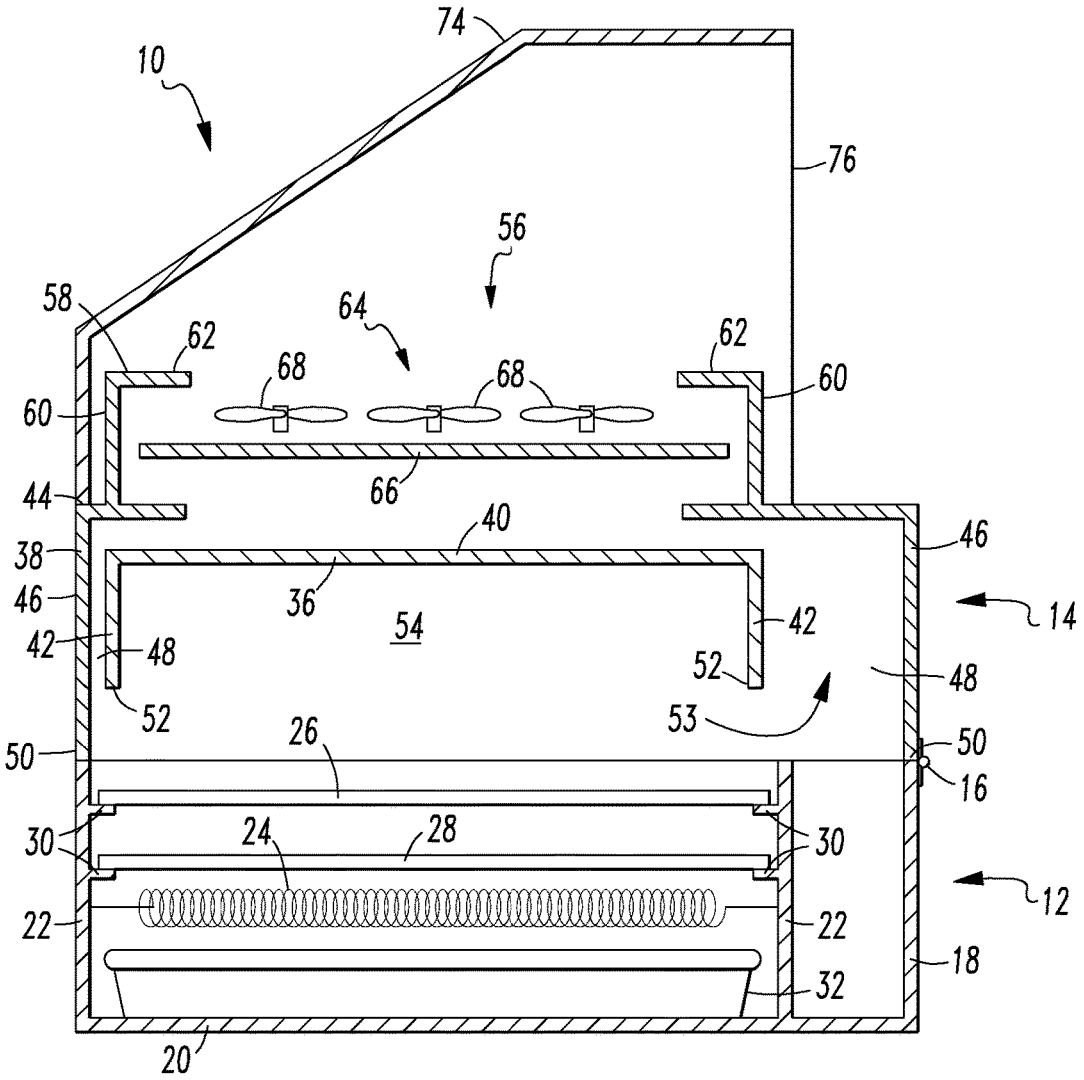
FIG. 3 is a front cross-sectional view of the indoor grill of FIG. 1.
Figure 4:
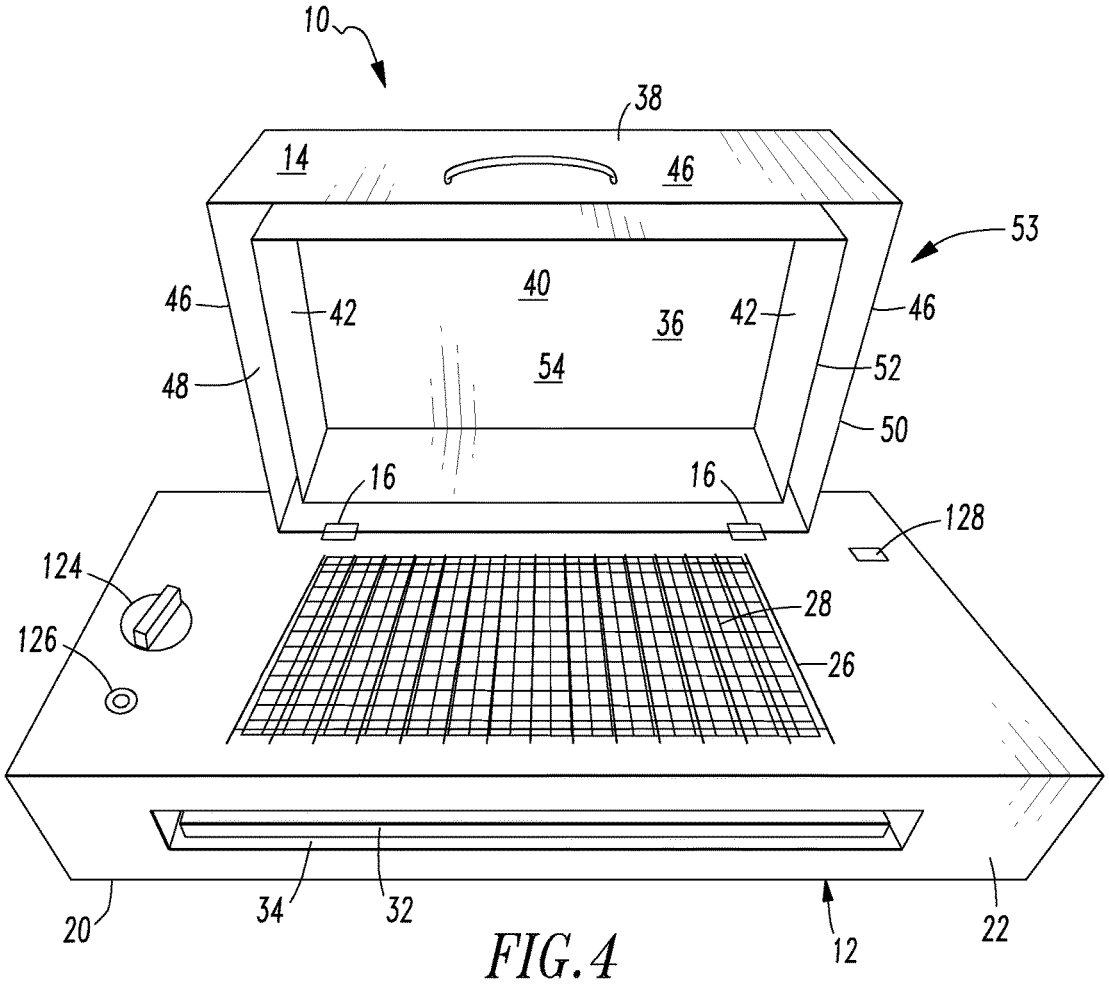
FIG. 4 is a front perspective view of the indoor grill of FIG. 1, showing the lid open.
Figure 5:
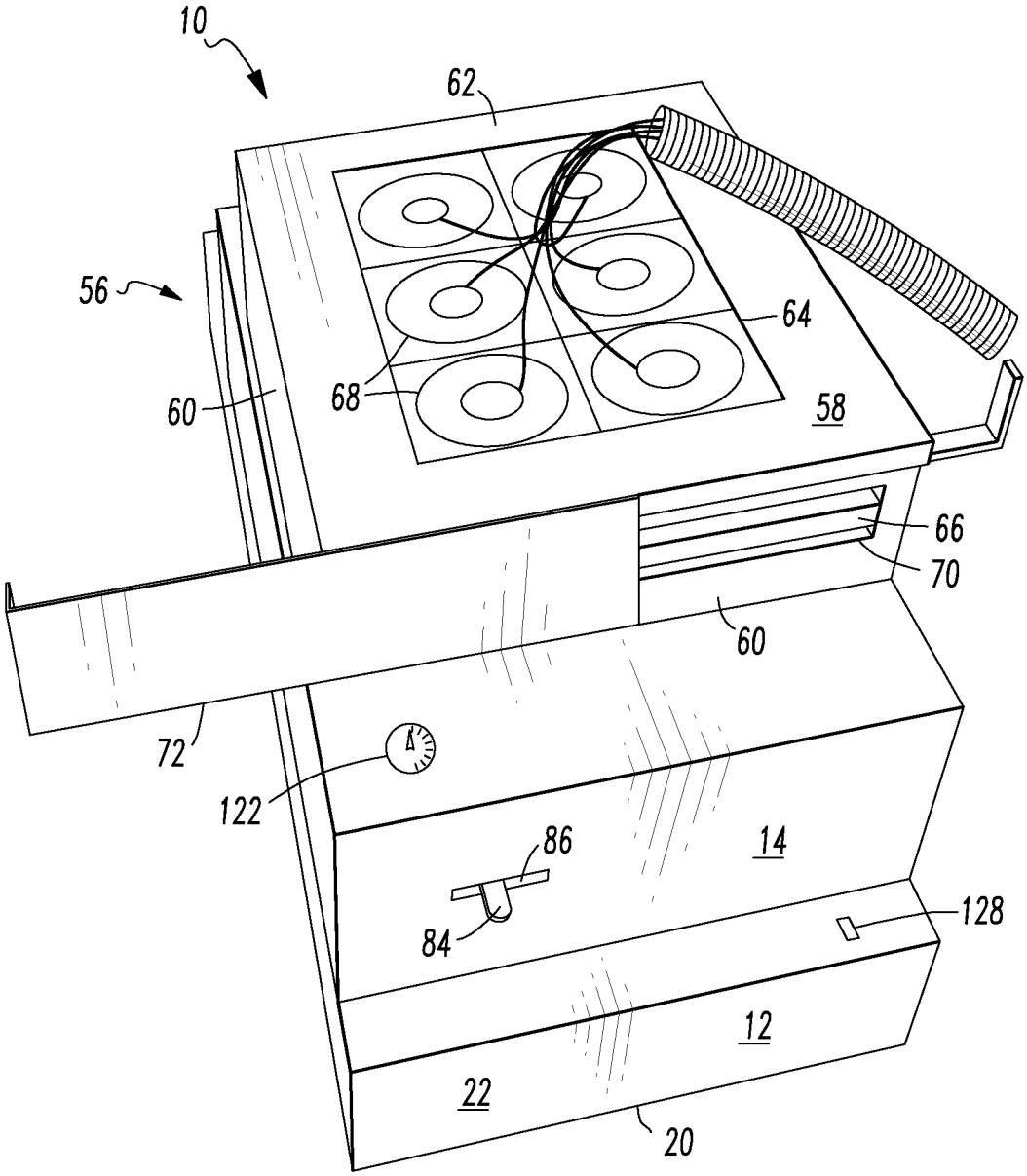
FIG. 5 is a top perspective view of the indoor grill of FIG. 1, showing the filter system cover removed and filter door partially opened.
Figure 6:
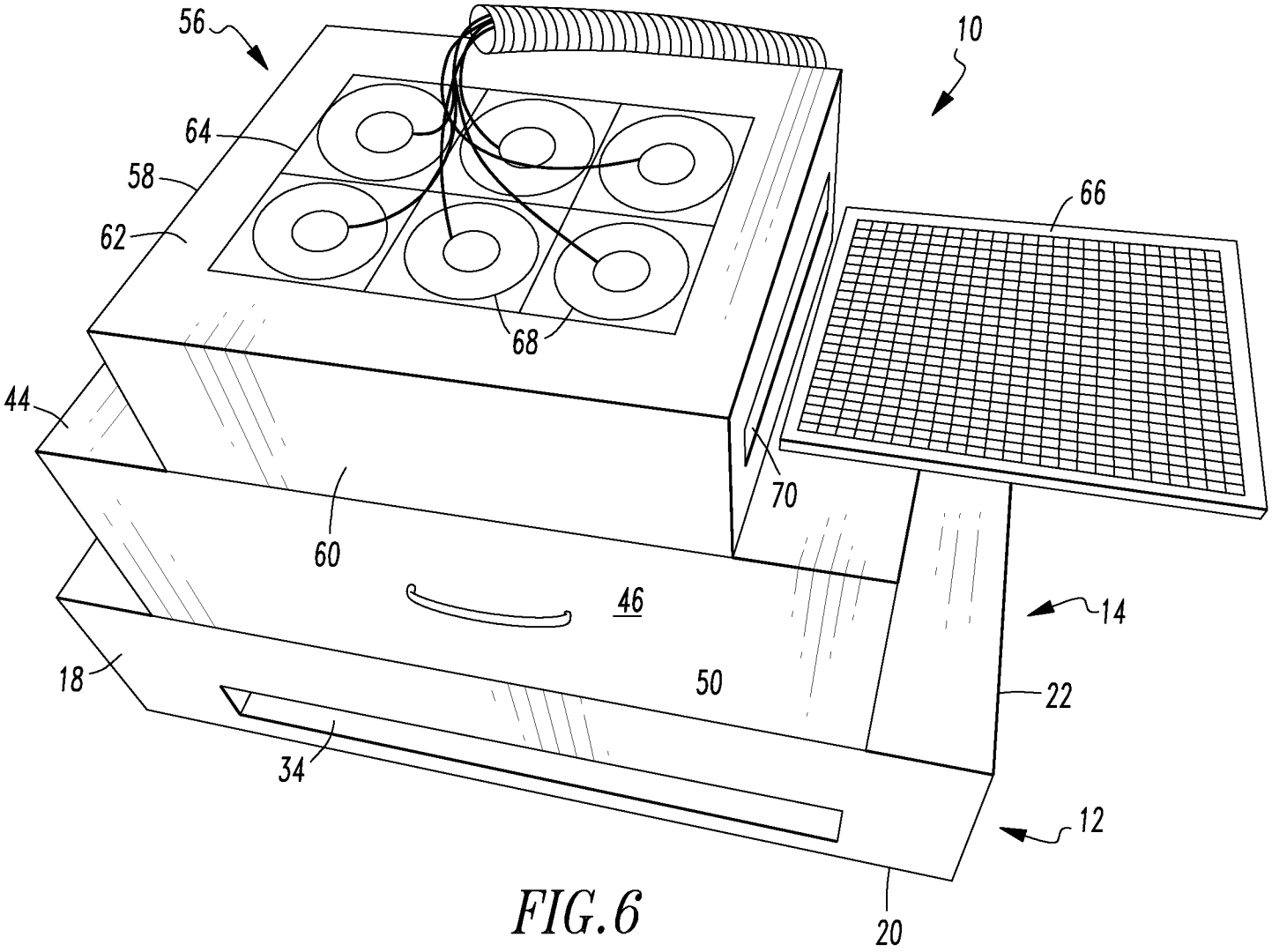
FIG. 6 is a top perspective view of the indoor grill of FIG. 1, showing the filter removed from the filter system.
Figure 7:
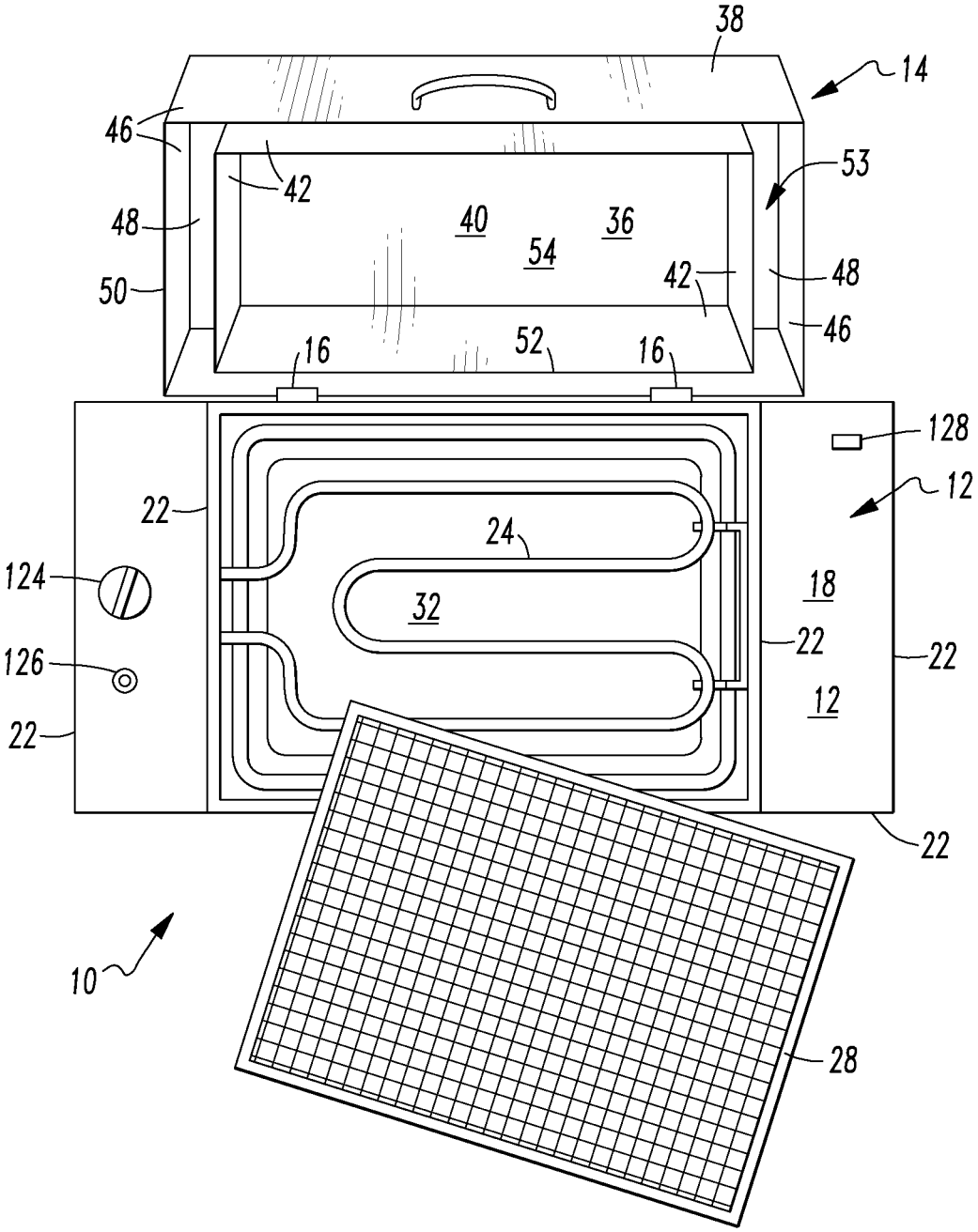
FIG. 7 is a top perspective view of the indoor grill of FIG. 1, showing the lid open, and grill racks removed.

Referring to FIGS. 3, 5-6, and 8, a filtration system 56 is operatively connected to the space 48 between the inner hood 36 and outer hood 38. In the illustrated example, the filtration system 56 is disposed on top of the hood 14, and communicates with the space 48 through the opening 57 within the top 44 of the outer hood 38. The filtration system includes a housing 58 including a plurality of sides 60 and a top 62 defining an opening 64 therein. The filtration system includes a filter 66, which in the illustrated example is the same type of filter that is used in a typical hood over a kitchen stove. At least one fan 68 is disposed adjacent to the filter 66. The fan 68 is structured to create an airflow from the space 48 through the filter 66 and then through the opening 64. A slot 70 is defined within one side 60 of the housing 58 to facilitate removal and replacement of the filter 66. In the illustrated example, the slot 70 may be covered by the door 72, which in the illustrated example is a sliding door 72. The illustrated example of the filtration system 56 includes a removable cover 74 (FIGS. 1-3). The illustrated example of the cover 74 includes an open back 76, and is structured to direct air flow from the housing 58 towards the back of the grill 10.

Referring to FIGS. 1, 3-4, and 7-8, the heating element 24 in the illustrated example is an electric heating element, although the invention is not restricted to electric heating elements. Heat may be supplied by liquid or solid burnable fuels without departing from the scope of the invention. Some examples of the heating element 24 may be connected to a power supply (not shown, but well-known in the art), through a temperature control mechanism and possibly a timing control mechanism. Different temperature and/or timing mechanisms, both of which are well-known in to those skilled in the art, can be used without departing from the scope of the invention. Additionally, the power supply for the fan 68 may be incorporated into the power supply for the heating element 24, with or without a separate on/off control, or may be a separate power supply. In the illustrated example, a separate switch 128 is provided to control the fan 68. An indicator light 126 may optionally be provided to show when power is being applied to the heating element 24. Temperature can be controlled by a simple potentiometer connected to the power supply for the heating element for regulating the voltage and/or current supplied to the heating element. Alternatively, temperature can be controlled by providing a temperature-setting control, as well as a temperature sensor such as a bimetallic strip or other known temperature sensor within the space 54. Such temperature controls are well-known in conventional ovens and therefore not described further herein. In either case, a knob 124 may be used to permit a user to control the temperature. Temperature may also be monitored by a user using an external temperature gauge 122. Timing may be controlled by any well-known timer, including one that is structured to cut off power to the heating element 24 upon completion of the predetermined cooking time. Such timers are conventional in toasters, toaster ovens, etc., and are therefore not described further herein.

In use, water is placed within the water tray 32, and the tray 32 is placed below the heating element 24. The filter 66 is placed within the filtration system 56 if it is not already in place, and the door 72 is closed. The cover 74 is placed over the housing 58 if it is not already in place. The hood 14 is raised, and food to be cooked is placed on the rack 26. The rack 28 serves to catch any food that may fall through the rack 26. The hood 14 is closed. Power is supplied to the heating element 24 and fan 68. Heat is retained within the space 54, thereby increasing the cooking temperature and increasing the likelihood of caramelization and grill marks. The space 48 resists excessive heating of the outer housing 38 of the hood 14, thus enhancing the safety of an individual who may touch the outer hood 38 during cooking. Grease and fat that drips from the food will largely be captured by the water tray 32, reducing but not eliminating the production of smoke. The smoke that is produced will be retained to a limited extent within the space 54. When the smoke fills the space 48, the smoke will begin to pass into the space 48, where it will be drawn into the filter 66 before the filtered air 68 is expelled through the openings 64, 76. Thus, some smoke is retained for flavoring of the food, but the amount of smoke retained is limited.

Because some smoke is retained within the space 54, a means of ensuring that the unfiltered smoke does not pass into the interior of a building in which the grill 10 is being used is desired. The manner in which smoke is drawn into the space 48 is specifically designed for this purpose. When the hood 14 is closed, only limited smoke is drawn past the bottom edge 52 of the inner housing 36 and into the space 48. When the hood is opened, as shown in FIG. 8, the bottom edges 50, 52 of the hood 36 are raised above the base 12, the entrance 53 to the space 48 passes over the smoke that was immediately beforehand contained under the hood 14. As this edge passes over that smoke, the smoke will be drawn into the space 48 and drawn through the filtration system 56, thus resisting any tendency of smoke to exit the grill unfiltered when the hood 14 is opened.

Figure 9:
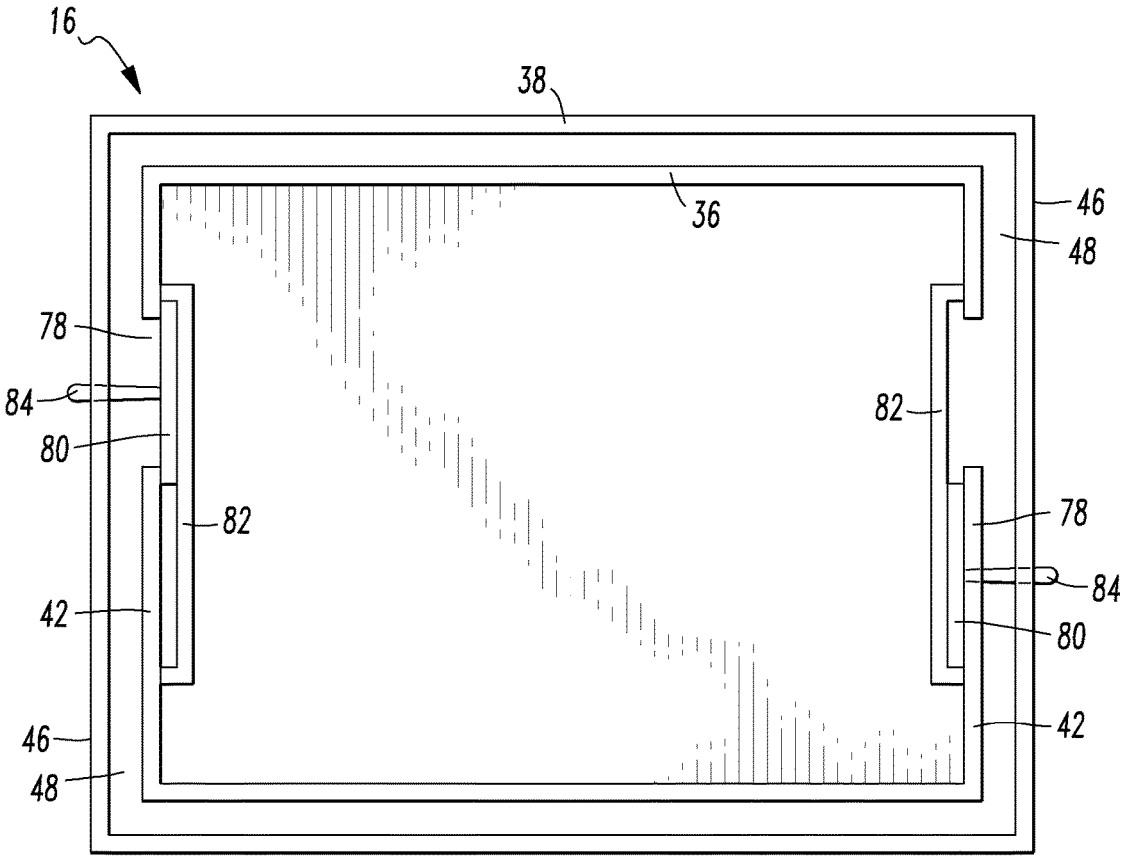
FIG. 9 is a top cross-sectional view of the lid, showing a pair of sliding doors covering openings defined within the interior lid housing.
Figure 10:
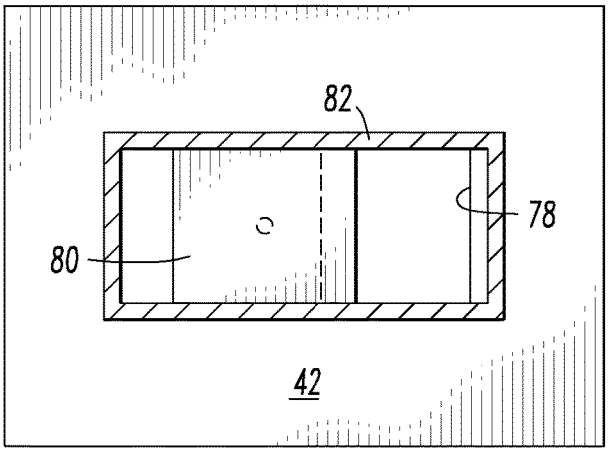
FIG. 10 is a side view of a side wall of the interior lid housing, showing a door of FIG. 9 partially opened.

Some examples of the grill 10 may include an additional smoke control system, which is illustrated in FIGS. 9-10. In these examples, the sides 42 of the interior housing 36 define at least one opening 78 therein. The openings 78 may be covered by a door 80 that is operable from outside the hood 14 when the hood 14 is closed. In the illustrated example, the door 80 is a sliding door 80 that is retained by lips 82. A tab 84 on the door 80 protrudes through a slot 86 defined within the side 46 of the exterior housing 38, permitting the tab 84 to be grasped to open and close the door 80 while the hood 14 is closed. The door 80 may be kept fully closed, partially closed, or fully open during cooking, depending on the amount of smoke generated and desired level of smoke retention during cooking. Before opening the hood 14, the door 80 may be fully opened to withdraw some smoke from the interior region 54 into the space 48 prior to opening the hood 14.

Figure 11:
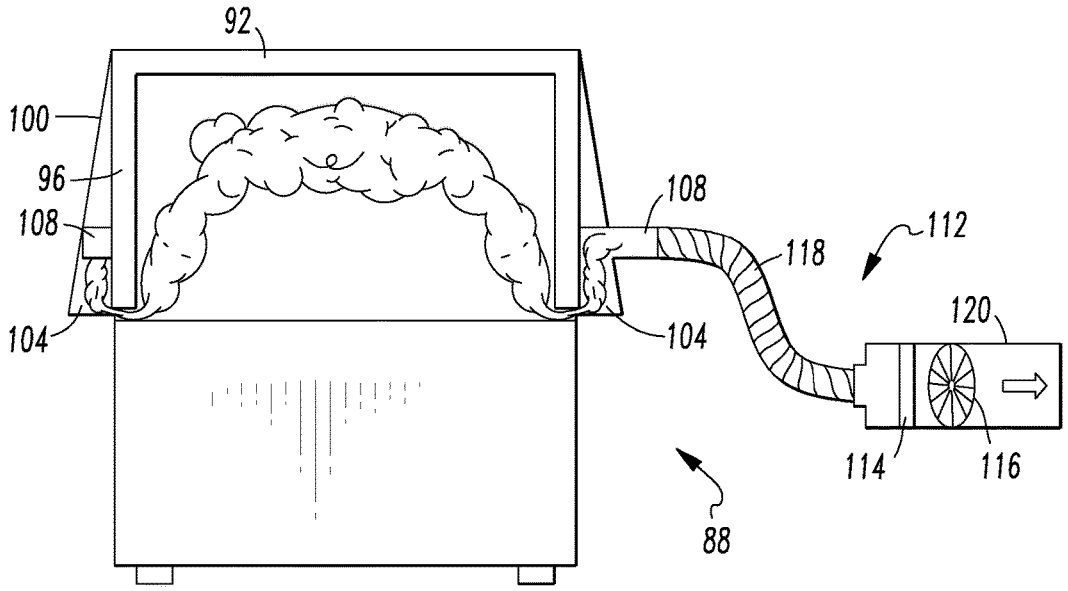
FIG. 11 is a front cross-sectional view of another example of an indoor grill.
Figure 12:
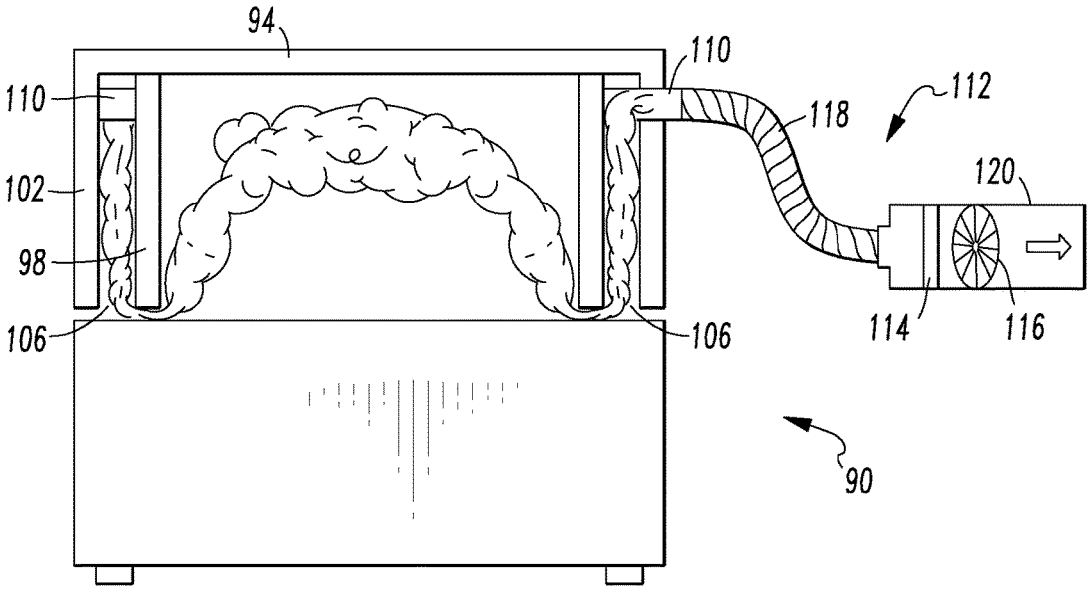
FIG. 12 is a front cross-sectional view of yet another example of an indoor grill.

Other variations of the indoor grill are illustrated in FIGS. 11-12. The indoor grills 88, 90 are similar to the grill 10 in every respect except for the specific manner in which smoke is drawn from the space between the interior and exterior hood housings into the filtration system and out of the grill. The grills 88, 90 each have hoods 92, 94 having interior walls 96, 98 and exterior walls 100, 102 defining a space 104, 106 therebetween. The grills 88, 90 include a conduit 108, 110 within the space 104, 106 into which smoke entering the space 104, 106 is directed. The conduit 108 is disposed in a lower portion of the space 104, while the conduit 110 is disposed in an upper portion of the space 106. The conduits 108, 110 each lead into a filtration system 112. The illustrated example of the filtration system 12 includes a filter 114 disposed adjacent to a fan 116. In the illustrated example, a flexible conduit 118 is provided between the conduit 108, 110 and the housing 120 for the filter 114 and fan 116. Some examples of the filtration system 112 are structured to direct filtered air into a pre-existing duct system, for example, a dryer duct or intake of a range hood, so that filtered air, and any smoke that may have passed through the filtration system 112, can be directed to the exterior of the building in which cooking is performed.

The indoor grill therefore provides a means of utilizing a controlled amount of smoke for food flavoring during cooking, while resisting passage of unfiltered smoke to the exterior of the grill. The grill further provides a means of retaining heat within the grill during cooking to increase the likelihood of caramelization and grill marks, while insulating the exterior of the grill from heat for enhanced safety. Additionally, the grill provides a means of retaining a quantity of smoke during cooking, while also directing the retained smoke through the filtration system before or upon opening of the grill.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. An indoor grill, comprising:

a base, comprising:

a base housing having an open top;

a heating element disposed within the base housing;

a rack disposed above the heating element; and a hood hingedly secured to the base, the hood pivoting between a closed position wherein the hood substantially covers the rack, and an open position, the hood comprising:

an outer housing, the outer housing having a plurality of side walls, the side walls each defining a bottom edge that is structured to abut the base when the hood is in its closed position;

an inner housing, the inner housing defining a plurality of side walls, the side walls each defining a bottom edge that is structured to be spaced from the base and the rack when the hood is in its closed position; and the inner housing and outer housing defining an open space therebetween and a smoke entrance between the bottom edges of the inner and outer walls; and a filtration system in communication with the open space between the inner housing and outer housing, the filtration system having a filter, and a fan that is structured to create an airflow from the open space between the inner and outer housings through the filter;

whereby a quantity of smoke is retained within the hood during cooking, and excess smoke is drawn into the space between the inner housing and outer housing, and the smoke is filtered before exiting the grill; and whereby opening the grill raises the smoke entrance above the grill rack, thereby drawing previously retained smoke into the smoke entrance and then through the filtration system.

2. The indoor grill according to claim 1, wherein the inner housing of the hood further comprises:

a secondary smoke opening defined within a wall;

a door that is structured to move between an open position wherein passage of smoke through the secondary smoke opening is permitted, and a closed position wherein the door resists passage of smoke through the secondary smoke opening; and an operating handle operatively connected to the door, the operating handle being structured to be grasped from outside the outer housing of the hood when the hood is in its closed position.

3. The indoor grill according to claim 1, further comprising a water tray disposed within the base, below the heating element.

* * * * *